US005356763A

United States Patent [19]

Takahashi et al.

[11] Patent Number: 5,356,763

[45] Date of Patent: Oct. 18, 1994

[54] SILVER HALIDE COLOR PHOTOGRAPHIC MATERIAL

[75] Inventors: Osamu Takahashi; Nobutaka Ohki, both of Kanagawa, Japan

[73] Assignee: Fuji Photo Film Co., Ltd., Minami-ashigara, Japan

[21] Appl. No.: 24,437

[22] Filed: Mar. 1, 1993

[30] Foreign Application Priority Data

Mar. 4, 1992 [JP] Japan ..... 4-081393

[51] Int. Cl.[5] ..... G03C 1/46

[52] U.S. Cl. ..... 430/505; 430/558; 430/551; 430/546; 430/544; 430/372

[58] Field of Search ..... 430/558, 551, 372, 505, 430/546, 544, 567

[56] References Cited

U.S. PATENT DOCUMENTS

| | | | |
|---|---|---|---|
| 5,004,678 | 4/1991 | Seto et al. | 430/551 |
| 5,021,328 | 6/1991 | Takahashi | 430/502 |
| 5,037,730 | 8/1991 | Aoki et al. | 430/546 |
| 5,162,197 | 11/1992 | Aoki et al. | 430/546 |
| 5,169,742 | 12/1992 | Takahashi et al. | 430/551 |
| 5,208,140 | 5/1993 | Nishijima et al. | 430/551 |

FOREIGN PATENT DOCUMENTS

| | | |
|---|---|---|
| 0459334 | 4/1991 | European Pat. Off. . |
| 0457543 | 5/1991 | European Pat. Off. . |
| 0431329 | 12/1991 | European Pat. Off. . |

*Primary Examiner*—Charles L. Bowers, Jr.
*Assistant Examiner*—Geraldine Letscher
*Attorney, Agent, or Firm*—Burns, Doane, Swecker & Mathis

[57] ABSTRACT

A silver halide color photographic material enables rapid processing, provides a high quality image and has excellent light fastness under extensive conditions, even under high humidity comprises a support, provided thereon at least three silver halide emulsion layers each containing at least one different coupler for forming a different dye by a coupling reaction with the oxidation product of an aromatic primary amine developing agent and each having a different light sensitivity, and at least one anti-color mixing layer provided between each of the emulsion layers and comprising a light-insensitive layer, wherein at least one of the above silver halide emulsion layers contains silver halide grains having a silver chloride content of 90 mole % or more and a magenta coupler represented by the following formula (I) and at least two of the anti-color mixing layers contain at least one anti-color mixing agent having a molecular weight of 350 or more and at least one high boiling organic solvent having the dielectric constant of 5.0 or more:

(I)

wherein $R_1$ represents a hydrogen atom or a substituent; $Z_a$, $Z_b$, and $Z_c$ each represent methine, substituted methine, =N—, or —NH—; Y represents a hydrogen atom or a group capable of splitting off upon a coupling reaction with the oxidation product of a developing agent; provided that a dimer or polymer may be formed via R, Y or $Z_a$, $Z_b$ or $Z_c$ each of which is a substituted methine.

18 Claims, No Drawings

SILVER HALIDE COLOR PHOTOGRAPHIC MATERIAL

FIELD OF THE INVENTION

The present invention relates to a silver halide color photographic material which can be rapidly processed, provide a high quality image and have excellent light fastness under extensive conditions, even under high humidity.

BACKGROUND OF THE INVENTION

In recent years, the art has sought to provide a silver halide color photographic material which can provide a high quality image and excellent color image preservability and which is capable of being rapidly processed.

In the development processing of silver halide photographic materials, continuous processing is typically carried out with an automatic developing machine which is located at the respective labs. In such labs, it is desired that the light-sensitive materials be processed are returned to the clients within the same day, often within one hour from receipt, and therefore, the need for a rapid processing has been growing.

Further, shortening of the processing time leads to the improvement in a production efficiency and enables a cost reduction. This has further accentuated the need for rapid processing.

Under such the circumstances, it is known that the shape, size and composition of the silver halide grains contained in a silver halide emulsion used for a light-sensitive material affect a developing speed and others to a large extent. It is further understood that the halogen composition has a large influence and, particularly, the use of high chloride silver halide allows a markedly high developing speed.

From the viewpoint of an environmental protection and the reduction in the load of the preparation work of a developing solution, the use of a color developing solution which is free of benzyl alcohol is desired. Further, the exclusion of sulfite used as an anti-oxidation agent for a developing agent in the color developing solution is also desired because the sulfite competitively reacts with an oxidation product of the color developing agent and a coupler to lower image density which changes the amount of sulfite, which is further accompanied by a change in color dye density.

Under the above background, there has been recently employed a method in which high chloride silver halide is used in the field of a color paper and a processing is carried out with a color developing solution containing substantially no benzyl alcohol and sulfite.

Meanwhile, in terms of image quality and color image preservability, a big problem resides in the use of a 5-pyrazolon series coupler which has so far been used has a subabsorption that is not preferred in terms of a color reproduction in the vicinity of 430 nm in the dye formed therewith, which results in yellow formation (i.e., Y-stain) at a non-developed portion when stored in the bright and dark rooms.

One solution involves the use of the magenta coupler of pyrazolotriazoles described in U.S. Pat. No. 3,725,067, JP-A-59-162548 (the term "JP-A" as used herein means an unexamined published Japanese patent application) and JP-A-59-171956, and *Research Disclosures* Nos. 24220, 24230 and 24531. The dyes formed from these couplers have a very small sub-absorption in the vicinity of 430 nm and a very little generation of Y-stain by light, heat and humidity. Accordingly, they have been put to a practical use.

Meanwhile, another problem resides in that the use of high chloride silver halide is liable to cause color mixing. One of the causes therefor is believed to be that, because the silver developing speed is markedly accelerated, the degree at which the oxidation product formed by a silver development can not completely react with the coupler contained in the same layer and, thus, diffuses to the other layers is increased. The efficiency in the reaction of an anti-color mixing agent contained in an anti-color mixing layer with the oxidation product of a developing agent is lowered for the same reasons. Further, this phenomenon is promoted when a color developing solution which contains no above benzyl alcohol and sulfite is used.

As one solution to this problem, the amount of anti-color mixing agent which is contained in the anti-color mixing layer provided between the emulsion layers and reacts with the oxidation product of a developing agent is increased up to the amount sufficient to prevent a color mixing. In this case, the amount of the anti-color mixing agent left unreacted after a development processing is increased as well.

It has been found that the use of a pyrazolotriazole series magenta coupler under a rapid processing conditions employing high chloride silver halide emulsions deteriorates the light fastness of a formed dye under high humidity conditions to a large extent when compared with that deterioration under low humidity conditions. Where a conventional pyrazolone series magenta coupler is used, this humidity dependency relating to light fastness has not substantially been observed.

The investigation of this problem has resulted in determining that the anti-color mixing agent is related to the cause for the deterioration of a light fastness under high humidity conditions.

SUMMARY OF THE INVENTION

The present invention has been made under the above circumstances.

The first object of the present invention is to provide a silver halide color photographic material which has excellent color reproducibility and which, even when rapidly processed, can provide an excellent light fastness under conditions of either high humidity or low humidity.

The second object of the present invention is to provide a method for forming a color image, in which excellent color reproducibility is provided and even a rapid processing provides a color photo having an excellent light fastness under conditions of either high humidity or low humidity.

The intensive investigations made by the present inventors have resulted in solving the above subjects by a silver halide color photographic material as well as a method for forming a color image.

In one aspect, the present invention relates to a silver halide color photographic material comprising a support having provided thereon (A) at least three silver halide emulsion layers each containing at least one different coupler for forming a different dye by a coupling reaction with the oxidation product of an aromatic primary amine developing agent and each having a different light sensitivity, and (B) at least one light-insensitive anti-color mixing layer provided between each of the silver halide emulsion layers, wherein at least one of the silver halide emulsion layers contains silver halide grains having a silver chloride content of 90 mole % or more and a magenta coupler represented by the following formula (I) and at least two (preferably all) of the anti-color mixing layers contain at least one anti-color mixing agent having a molecular weight of 350 or more and at least one high boiling organic solvent having the dielectric constant of 5.0 or more:

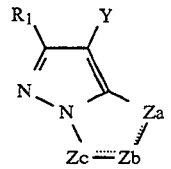

(I)

wherein $R_1$ represents a hydrogen atom or a substituent; $Z_a$, $Z_b$, and $Z_c$ each represent methine, substituted methine, =N—, or —NH—; Y represents a hydrogen atom or a group capable of splitting off upon a coupling reaction with the oxidation product of a developing agent; provided that a dimer or polymer may be formed via $R_1$, Y or $Z_a$, $Z_b$ or $Z_c$ each of which is a substituted methine.

Furthermore, the anti-color mixing agent having the molecular weight of 350 or more is preferably represented by the following formula (II):

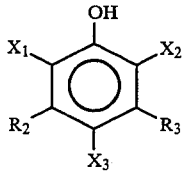

(II)

wherein $X_1$, $X_2$, $X_3$, $R_2$ and $R_3$ each represent a hydrogen atom or a substituent; at least one of $X_1$, $X_2$ and $X_3$ represents a hydroxy group or a sulfonamide group; provided that $X_1$, $X_2$, $X_3$, $R_2$ and $R_3$ are selected so that the molecular weight of the anti-color mixing agent becomes 350 or more; the groups which are present at an ortho position each other may be combined with each other to form a ring (for example, 5- to 6-membered saturated or unsaturated hydrocarbon ring or hetero-cyclic ring); and the compound represented by formula (II) may be combined via any of $X_1$, $X_2$, $X_3$, $R_2$ and $R_3$ with a polymer chain or combined with another compound of formula (II) to form a dimer or polymer.

In another aspect, the anti-color mixing layer contains at least one high boiling organic solvent having the dielectric constant of 6.0 or more.

In yet another aspect, a light-insensitive layer provided on the emulsion layer farthest from the support (the side opposite to the support) is substantially free of hydroquinones.

The present invention also relates to a method for forming a color image comprising the steps of subjecting the above described silver halide color photographic material to imagewise exposure and then processing the photographic material in a color developing solution which is substantially free of benzyl alcohol.

DETAILED DESCRIPTION OF THE PREFERRED EMBODIMENTS OF THE INVENTION

The magenta coupler represented by formula (I) will be explained below in detail.

An alkyl group, an alkoxy group, an aryl group, and an aryloxy group, each of which are substituted or unsubstituted, are examples of the substituents represented by $R_1$ in formula (I) and the substituents of the substituted methine groups represented by $Z_a$, $Z_b$, and $Z_c$. The details of these substituents are described at the second column, line 41 to the eighth column, line 27 of U.S. Pat. No. 4,540,654 which is incorporated by reference.

Preferred as a coupling splitting group is a halogen atom or a group splitting at a sulfur, oxygen or nitrogen atom. In particular, a halogen atom and an arylthio group are preferred. The details of the coupling splitting group are described at the fourth column, line 30 to the fifth column, line 24 of U.S. Pat. No. 4,540,654.

One of the $Z_a$—$Z_b$ bond and the $Z_b$—$Z_c$ bond is preferably a double bond and the other is a single bond. Where the $Z_b$—$Z_c$ bond is a carbon-carbon double bond, it can be part of an aromatic ring.

Among the pyrazoloazole series couplers represented by formula (I), imidazo [1, 2-b]pyrazoles described in U.S. Pat. No. 4,500,630 are preferred in terms of a little subabsorption in a developed dye and a light fastness and pyrazolo [1, 5-b] [1, 2, 4]triazole described in U.S. Pat. No. 4,540,654 is particularly preferred. Each of which are incorporated by reference in their entirety.

In addition, preferably used are the pyrazlo-triazole couplers in which a branched alkyl group is bonded to a 2-, 3-or 6-position of a pyrazolotriazole ring, as described in JP-A61-65245, the pyrazoloazole couplers containing a sulfonamide group in a molecule, as described in JP-A-61-65246, the pyrazoloazole couplers having an alkoxyphenylsulfonamide ballast group, as described in JP-A-61-147254, and the pyrazolotriazole couplers having an alkoxy group or an aryloxy group at a 6-position, as described in European Patent Applications 226 849 A and 294 785 A.

Specific examples of the preferred magenta coupler represented by formula (I) are shown below but the present invention is not to be limited thereto.

| Compound | $R_{10}$ | $R_{11}$ | Y |
|---|---|---|---|
| | | 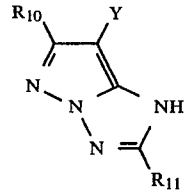 | |
| I-1 | $CH_3$— | 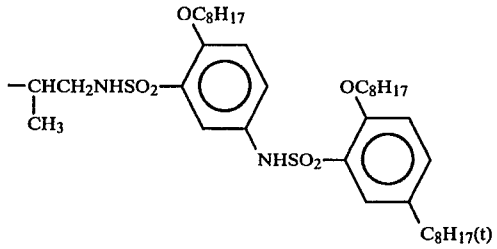 | Cl |
| I-2 | " | 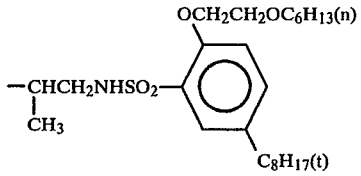 | " |
| I-3 | $(CH_3)_3C$— | 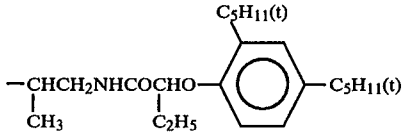 | 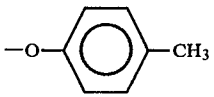 |
| I-4 | 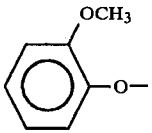 | 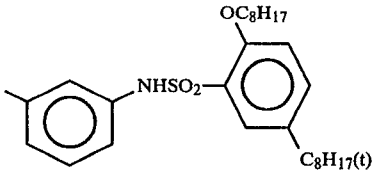 | 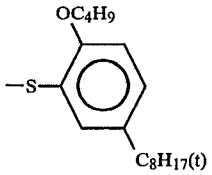 |

-continued
| Compound | $R_{10}$ | $R_{11}$ | Y |
|---|---|---|---|
| I-5 | $CH_3$— | 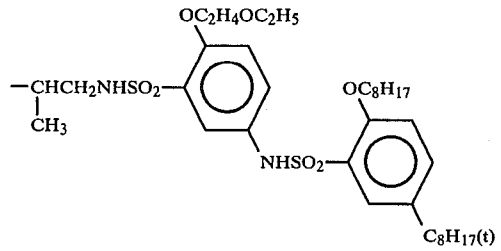 | Cl |
| I-6 | " | 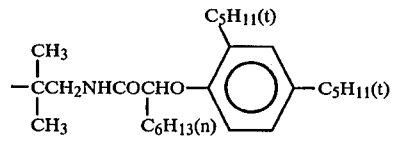 | " |
| I-7 | " | 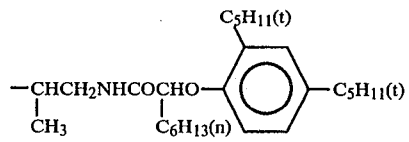 | " |
| I-8 | $CH_3$— | 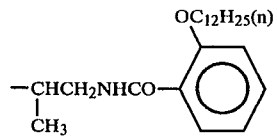 | Cl |
| I-9 | " | 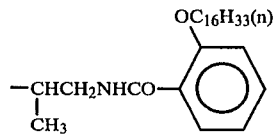 | " |

-continued
| Compound | $R_{10}$ | $R_{11}$ | Y |
|---|---|---|---|
| I-10 | 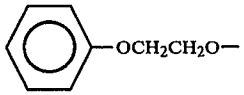 | 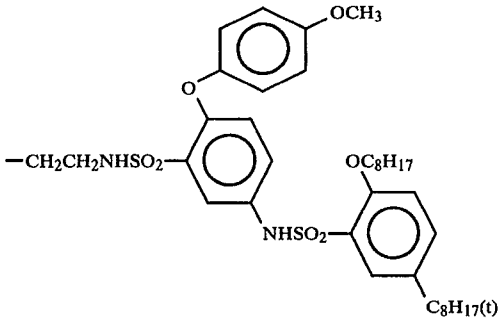 | 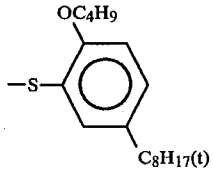 |
| I-11 | $CH_3CH_2O-$ | " | " |
| I-12 | 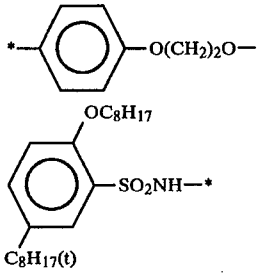 | 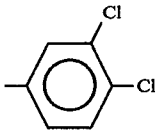 | 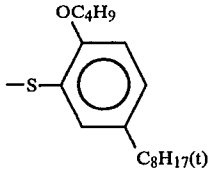 |
| I-13 | 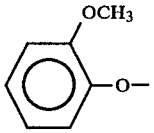 | 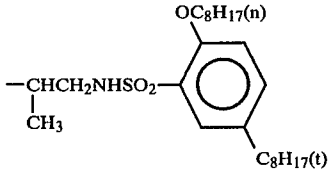 | Cl |
| I-14 | $(CH_3)_3C-$ | 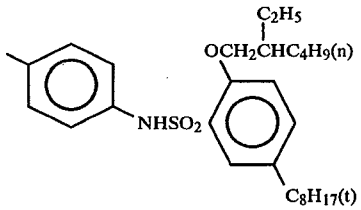 | Cl |

-continued
| Compound | $R_{10}$ | $R_{11}$ | Y |
|---|---|---|---|
| | | 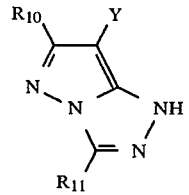 | |
| I-15 | $CH_3$— | 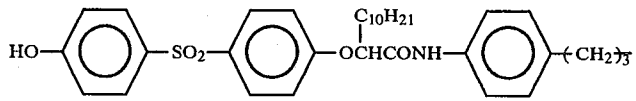 | Cl |
| I-16 | " | 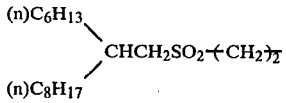 | " |
| I-17 | 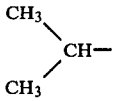 | 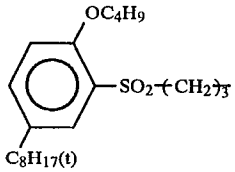 | " |
| I-18 | 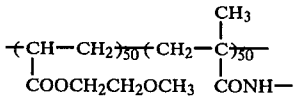 | 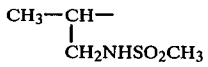 | " |
| I-19 | 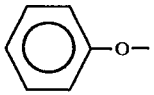 | 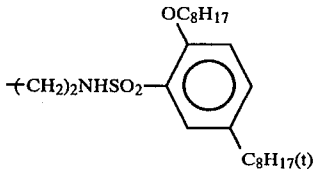 | Cl |

-continued
| Compound | $R_{10}$ | $R_{11}$ | Y |
|---|---|---|---|
| I-20 | $CH_3$— | 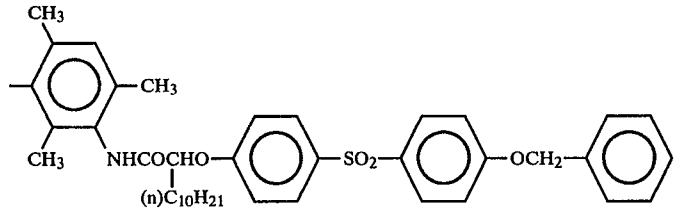 | " |
| I-21 | $(CH_3)_3C$— | 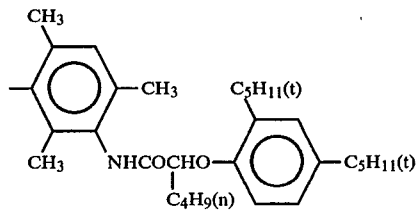 | " |
| I-22 | 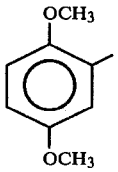 | 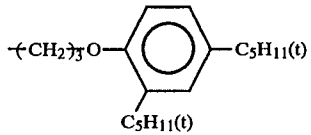 | Cl |
| I-23 | $CH_3$— | 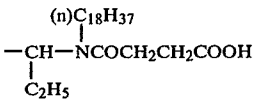 | " |

The coupler of formula (I) can be synthesized with reference to *Journal of the Chemical Society,* Perkin, I (1977), 2047 to 2052, U.S. Pat. No. 3,725,067, and JP-A-59-99437, JP-A58-42045, JP-A-59-162548, JP-A-59-171956, JP-A-60-33552, JP-A60-43659, JP-A-60-172982, and JP-A-60-190779.

The magenta coupler of the present invention represented by formula (I) can be used in the range of $1\times10^{-3}$ to 1 mole, preferably $1\times10^{-2}$ to $8\times10^{-1}$ mole per mole of silver halide.

More than one magenta coupler of the present invention may be used in combination, or the magenta coupler can be used in combination of another type of a coupler as far as the effects of the present invention are not damaged. In this case, the other type coupler is present in an amount in the range of 50 mole% or less, preferably 30 mole % or less based on the coupler of the present invention.

Further, various hydroquinone compounds may, optionally, be contained in the silver halide emulsion layer containing the magenta coupler of the present invention for the purposes of adjusting a gradation and preventing a fog. The addition amount thereof is preferably $2\times10^{-2}$ mole or less, more preferably $5\times10^{-3}$ or less per mole of silver. Most preferably, such compounds are not present.

Next, the anti-color mixing agent used in the present invention will be explained in detail.

As explained in JP-A-62-103638, an anti-color mixing agent is incorporated into a light-insensitive layer (an anti-color mixing layer) provided between the light-sensitive layers and is used in order to prevent color mixing which is generated when a color developing agent oxidation product formed in a light-sensitive emulsion during development is diffused into the other light-sensitive layer and reacts with a coupler present therein to form a color.

The anti-color mixing agent used in the present invention and having the molecular weight of 350 or more may be of any structure as long as it has the function to prevent the color mixing. There can be employed, for example, hydroquinones described in JP-A-62-103638, JP-B-51-12250 (the term "JP-B" as used herein means an examined Japanese patent publication), JP-B-59-37497, JP-B-61-13748, and JP-B-3-4891, gallic acids described in JP-B-1-34372, sulfon-amidephenols described in JP-B-3-11456, and the compounds described in JP-A-3-154051 and JP-A-3-164735.

Of the anti-color mixing agents used in the present invention, the compound represented by the following formula (II) is particularly preferred:

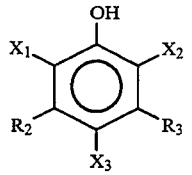

(II)

wherein $X_1$, $X_2$, $X_3$, $R_2$ and $R_3$ each represent a hydrogen atom or a substituent; at least one of $X_1$, $X_2$ and X3 represents a hydroxy group or a sulfonamide group; provided that $X_1$, $X_2$, $X_3$, $R_2$ and $R_3$ are selected so that the molecular weight of the anti-color mixing agent becomes 350 or more; the groups which are present at an ortho position each other may be combined with each other to form a ring; and the compound represented by formula (II) may be combined via any of $X_1$, $X_2$, $X_3$, $R_2$ and $R_3$ with a polymer chain or combined with another compound of formula (II) to form a dimer or polymer.

The compound represented by formula (II) will be explained below in detail.

Specific examples of the substituent represented by $X_1$, $X_2$, $X_3$, $R_2$ and $R_3$, include, for example, a halogen atom, a nitro group, a cyano group, a hydroxy group, a carboxyl group, a sulfo group, an amino group, an alkyl group (including the linear, branched and cyclic alkyls), an aryl group, an alkoxy group, an aryloxy group, an alkylthio group, an arylthio group, an acyl group, a sulfonyl group, a carbamoyl group, a sulfamoyl group, an alkoxycarbonyl group, an alkoxy-sulfonyl group, an amide group, a sulfonamide group, a ureido group, and a urethane group. These groups may be substituted further with other groups (for example, the above groups) if possible.

In formula (II), $X_3$ preferably represents a hydroxy group or a sulfonamide group, and $X_1$, $X_2$, $R_2$ and $R_3$ each preferably represent a hydrogen atom, a halogen atom, an alkyl group, an aryl group, an amide group, or a ureido group.

In formula (II), particularly preferred is the case where $X_3$ is a hydroxy group and at least one of $X_1$, $X_2$, $R_2$ and $R_3$ is an alkyl group (preferably an alkyl group having the carbon number of 10 or more; the upper limit of the carbon number is not specifically limited but 18 or more is preferred in practical terms) while the others are a hydrogen atom. More preferred is the case that both of $X_2$ and $R_2$ are an unsubstituted linear or branched alkyl group and that both of $X_1$ and $R_3$ are a hydrogen atom.

The molecular weight of the anti-color mixing agent used in the present invention is preferably 390 or more, more preferably 440 or more, and most preferably 500 or more. Where the anti-color mixing agent is a polymer, the molecular weight thereof is represented by a number average molecular weight. The upper limit of the molecular weight of the anti-color mixing agent is not specifically limited where the anti-color mixing agent is a polymer but it is preferably about 1,000 or less where the agent is the compound other than a polymer.

The total coated amount of the anti-color mixing agent contained in at least two intermediate layers provided between the respective silver halide emulsion layers is preferably 0.05 to 0.5 g/m$^2$, more preferably 0.05 to 0.4 g/m$^2$, and further more preferably 0.1 to 0.3 g/m$^2$.

Specific examples of the anti-color mixing agent used in the present invention and having the molecular weight of 350 or more are shown below, but the present invention is not to be limited thereto.

In the following compounds, M. W. means a molecular weight.

II-1
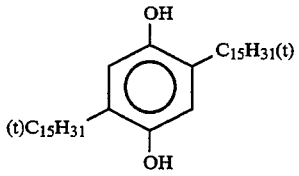
M.W. = 530.9
II-2
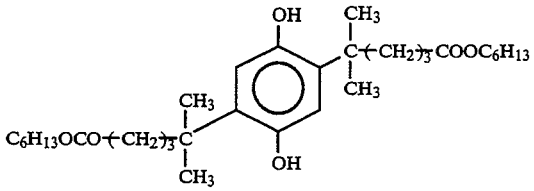
M.W. = 534.8
II-3
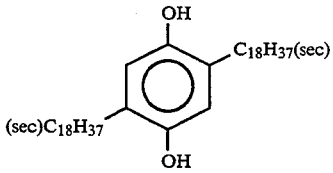
M.W. = 615.1
II-4
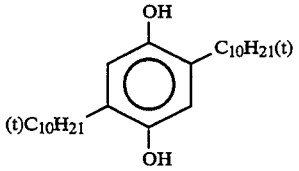
M.W. = 390.7
II-5
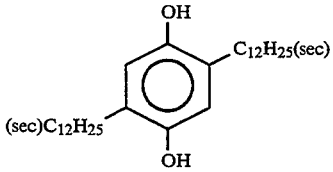
M.W. = 446.8
II-6
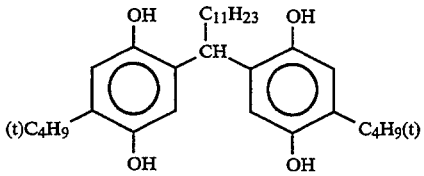
M.W. = 498.8
II-7
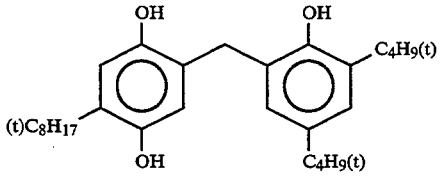
M.W. = 440.7
II-8
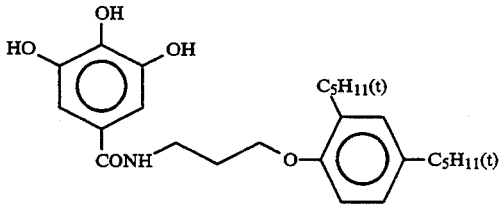
M.W. = 443.6

-continued
II-9
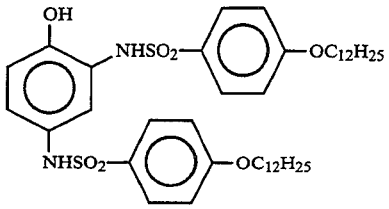
M.W. = 773.1
II-10
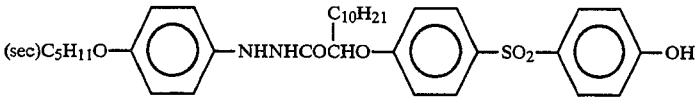
M.W. = 624.8
II-11
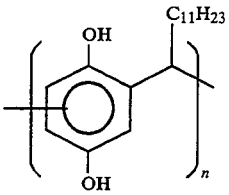
Average molecular weight about 3,000
II-12
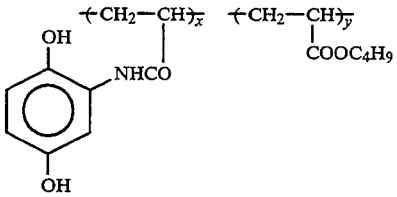
x:y = 30:70
Average molecular weight about 30,000
II-13
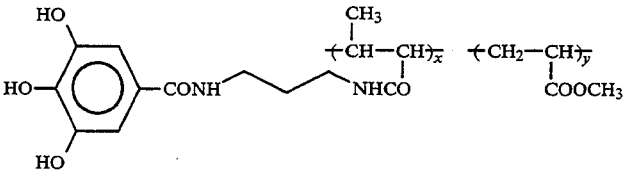
x:y = 50:50
Average molecular weight about 10,000
II-14
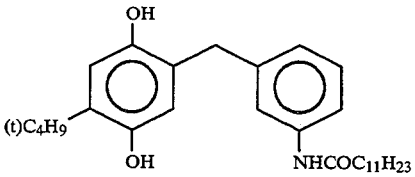
M.W. = 453.6
II-15
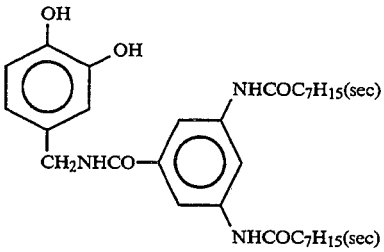
M.W. = 525.7
II-16
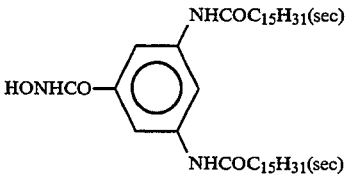
M.W. = 644.0

-continued
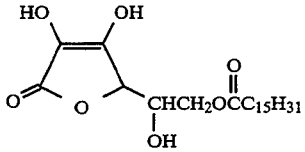
II-17
M.W. = 414.5
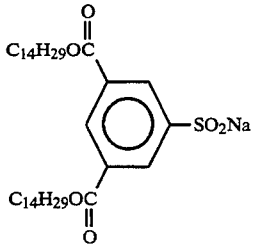
II-18
M.W. = 644.9
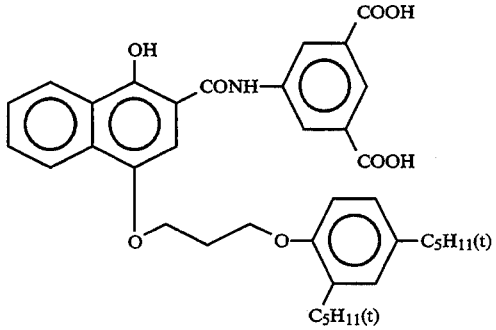
II-19
M.W. = 641.8
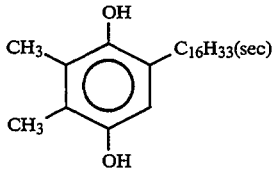
II-20
M.W. = 362.6
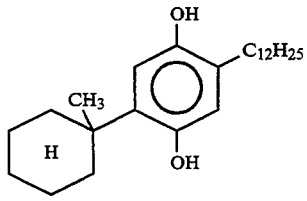
II-21
M.W. = 374.6
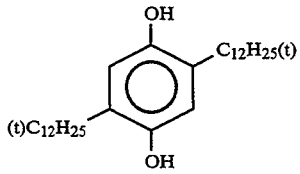
II-22
M.W. = 446.8
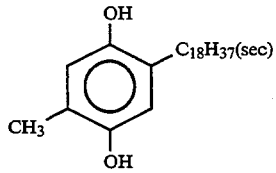
II-23
M.W. = 376.6
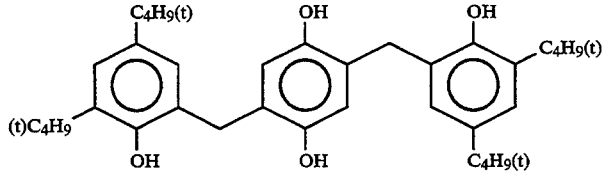
II-24
M.W. = 546.8

-continued

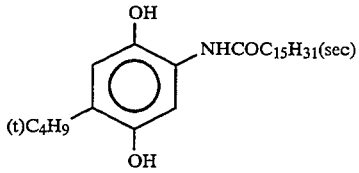

II-25

M.W. = 419.7

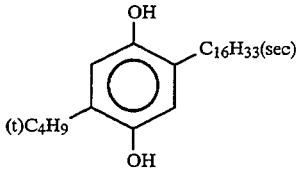

II-26

M.W. = 390.7

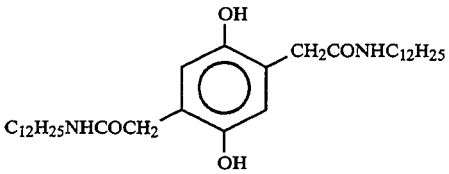

II-27

M.W. = 560.9

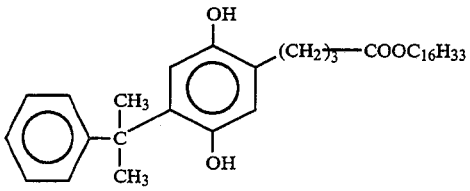

II-28

M.W. = 538.8

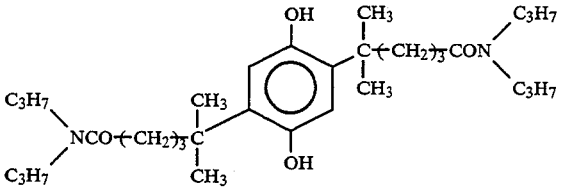

II-29

M.W. = 532.8

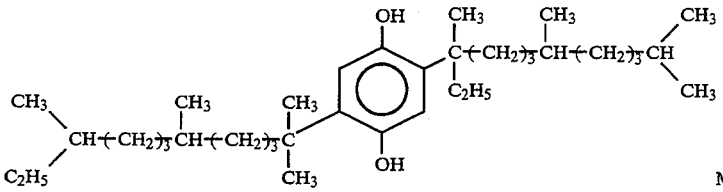

II-30

M.W. = 530.9

The anti-color mixing agent used in the present invention can be synthesized by the methods described in the above publications and the methods according thereto. In particular, alkylhydroquinones can be synthesized according to the following synthesis example.

SYNTHESIS EXAMPLE

(Synthesis of Exemplified Compound II-5)

Amberlist 15 (an ion exchange resin manufactured by Roam & Haas Co., Ltd.) 3.3 g (may be 1.7 g) was put in the three neck flask loaded with hydroquinone 33 g and 1-dodecene 111 g and the inner temperature was raised to 110° C. while stirring. The reaction was carried out at that temperature for 3 hours and then the inner temperature was raised to 140° C., followed by further carrying out the reaction for 5 hours. After the system was cooled down, n-hexane and ethyl acetate were added and the ion exchange resin was filtered off, followed by concentrating the filtrate. It was refined with a silica gel chromatography, whereby the compound II-5 72 g was obtained in the form of an oily isomer mixture.

The anti-color mixing agent used in the present invention is preferably present in the form of a fine oil drop obtained by dissolving it in a high boiling organic solvent and emulsify-dispersing.

The high boiling organic solvent used in the present invention is preferably a high boiling organic solvent having a dielectric constant of 5.0 or more, more preferably 6.0 or more. The high boiling organic solvent may be the mixture of two or more kinds, wherein the mixture has the dielectric constant of preferably 5.0 or more, more preferably 6.0 or more.

There are given as the example of the preferred high boiling organic solvent, for example, esters such as phthalate and phosphate, organic acid amide, and ketones, each having the dielectric constant of 6.0 or more.

The dielectric constant was measured by a transformer bridge method (TRS-10T, Ando Electric Co., Ltd.) at the conditions of 25° C. and 10 kHz.

The high boiling organic solvent preferably has a boiling point of 140° C. or more and a melting point of 100° C. or less, more preferably a boiling point of 160° C. or more and a melting point of 70° C. or less. The high boiling organic solvent may be a solid at ambient temperatures, wherein the dielectric constant is the value measured in the form of a liquid (a supercooling condition).

The ratio, by weight, of high boiling organic solvent to anti-color mixing agent in an intermediate layer is preferably 0.3 to 20, more preferably 0.5 to 10, and further more preferably 1 to 8.

In the above case, the amount of the anti-color mixing agent employed can be decreased while the effect of the present invention can be more markedly demonstrated and accordingly it is preferred.

The high boiling organic solvents are preferably the compounds represented by the following formula (III) to formula (VII):

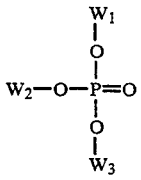
(III)

$W_1-COOW_2$ (IV)

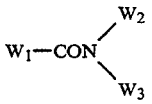
(V)

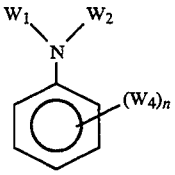
(VI)

$W_1-O-W_2$ (VII)

In formulas (III) to (VII), $W_1$, $W_2$ and $W_3$ each represent an alkyl group, a cycloalkyl group, an alkenyl group, an aryl group, or a heterocyclic group, each of which may be substituted or unsubstituted; $W_4$ represents $W_1$, $OW_1$, or $SW_1$; n is an integer of 1 to 5; when n is 2 or more, $W_4$'s may be the same or different each other; and $W_1$ and $W_2$, $W_2$ and $W_3$ or $W_3$ and $W_1$ may be combined with each other to form a condensed ring.

Among the compounds represented by formulas (III) to (VII), preferred are the compounds represented by formulas (III), (IV) and (V).

Specific examples of the high boiling organic solvent include the compounds described in JP-A-3-149545 and the compounds exemplified below but are not to be limited thereto.

$(C_5H_{11}O)_3P=O$ $\epsilon = 7.2$ III-1

III-2

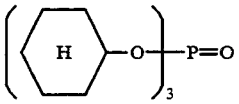
$\epsilon = 7.3$ $(C_6H_{13}O)_3P=O$ $\epsilon = 5.9$ III-3

-continued $(C_4H_9CH(C_2H_5)CH_2O)_3P=O$ $\epsilon = 4.8$ III-4

$(C_{10}H_{21}O)_3P=O$ $\epsilon = 4.2$ III-5

III-6

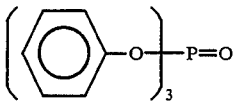
$\epsilon = 7.7$

III-7

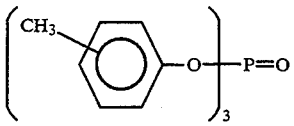
$\epsilon = 7.3$

III-8

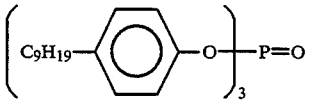
$\epsilon = 5.1$

III-9

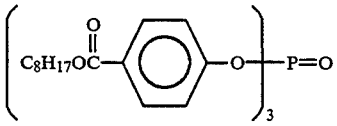
$\epsilon = 7.5$

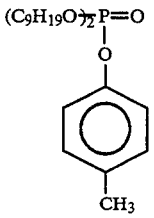
$\epsilon = 5.2$ III-10

IV-1

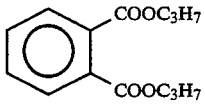
$\epsilon = 6.4$

IV-2

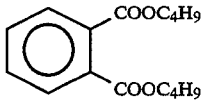
$\epsilon = 6.5$

IV-3

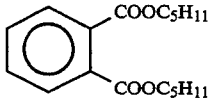
$\epsilon = 5.9$

IV-4

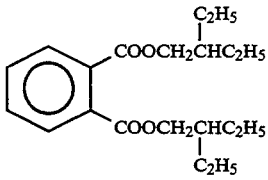
$\epsilon = 5.9$

-continued

IV-5

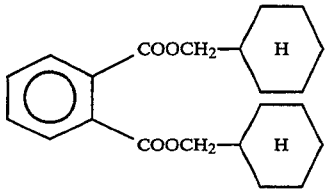

$\epsilon = 6.4$

IV-6

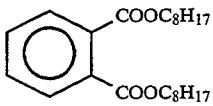

$\epsilon = 5.0$

IV-7

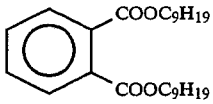

$\epsilon = 4.7$

IV-8

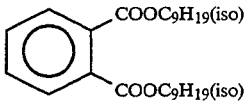

$\epsilon = 4.6$

IV-9

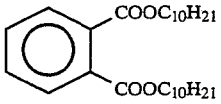

$\epsilon = 4.4$

IV-10

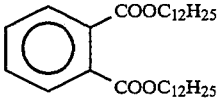

$\epsilon = 4.2$

V-1

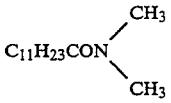

$\epsilon = 13.5$

V-2

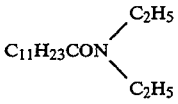

$\epsilon = 13.1$

V-3

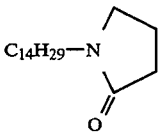

$\epsilon = 10.6$

V-4

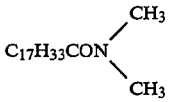

$\epsilon = 6.3$

V-5

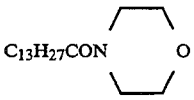

$\epsilon = 11.7$

The term "light-sensitive" or "light-insensitive" relates to light-sensitiveness not only to a visible ray but also to an electromagnetic wave in the infrared range. The color photographic material of the present invention is constituted by providing each at least one yellow color developing silver halide emulsion layer, magenta color developing silver halide emulsion layer, and cyan color developing silver halide emulsion layer on a support.

In general, there are provided on the support, the yellow color developing silver halide emulsion layer, magenta color developing silver halide emulsion layer, and cyan color developing silver halide emulsion layer in this order from the support side.

There can be incorporated into these light-sensitive emulsion layers, the silver halide emulsions having a sensitivities to the respective wavelength ranges and the dyes having the relationship of a complementary color with a sensitizing light, that is, yellow to blue, magenta to green and cyan to red, to carry out a color reproduction by a subtractive color process, provided that the developed color hue of a light-sensitive layer and a coupler may be of a constitution having no above correspondence.

As the silver halide emulsion used in the present invention, an emulsion comprising silver chloride or silver chloroiodobromide having the silver chloride content of 90 mole % or more can be employed. The silver iodide content is 1 mole % or less, preferably 0.2 mole % or less.

The halogen composition may be different or equivalent by grain. The use of the emulsion containing the grains each having the same composition readily homogenizes the quality of each of the grains and is preferred. With respect to the halogen composition distribution in the inside of the silver halide grain, there can be selected and used the grains of a so-called homogeneous type structure in which the composition is the same at any part of a silver halide grain, the grains of a so-called laminating type structure in which a core present at the inside of a silver halide grain and a shell (one layer or plural layers) surrounding it have the different halogen compositions, or the grains of the structure in which the portions having the different halogen compositions at the inside or surface of the grain in the form of a non-layer (the structure in which the portions of the different compositions are conjugated at the edge, corner or surface of the grain where they are present on the surface of the grain). The use of any of the latter two rather than the grains of the homogeneous structure is advantageous for obtaining a high sensitivity and is also preferred from the viewpoint of a pressure resistance performance. Where the silver halide grains have the above structures, a boundary portion having a different halogen composition may have a distinct boundary or an indistinct boundary in which a mixed crystal is formed according to the composition difference or the structure in which a continuous structural change is provided.

A so-called high silver chloride emulsion having a high silver chloride content is preferably used for a light-sensitive material suitable for a rapid processing. In the present invention, an emulsion having a silver chloride content of 90 mole % or more is used and an emulsion having the higher silver chloride content is preferably employed. The silver chloride content thereof is more preferably 95 mole % or more, particularly preferably 98 mole % or more. In such high silver chloride emulsions, the emulsion having the structure in which a silver bromide-rich phase is locally present in the form of the layer or non-layer as mentioned above in the inside of a silver halide grain or on the surface thereof is preferred. The halogen composition in the above local presence phase is preferably at least 10 mole %, more preferably 20 mole % or more, in terms of a silver bromide content. These local presence phase can be present in a grain inside or at the edge, corner or plane of a grain surface. It is particularly preferred at the corner portion of the grain.

A grain having a homogeneous type structure in which a halogen composition distribution in the grain is narrow is also preferred. Such a grain suppresses the sensitivity deterioration caused when a light-sensitive material is subjected to pressure.

The silver halide grain contained in the silver halide emulsion used in the present invention preferably has an average grain size (the grain size is defined by the diameter of the circle having the same area as that of the projected area of the grain and a number average is calculated therefrom) of 0.1 to 2 μm.

As to the size distribution of these grains, a so-called monodispersion in which a fluctuation coefficient (obtained by dividing the standard deviation in the grain size distribution with an average grain size) is 20 % or less, preferably 15 % or less, is preferred. In this case, the above monodispersed emulsions are preferably used for the same layer in a blend or simultaneously coated for the purpose of obtaining a broad latitude.

There can be used as the silver halide grains contained in a photographic emulsion, the grains having a regular crystal shape such as cube, octahedron and tetradecahedron and the grains having an irregular crystal shape such as sphere and plate. Further, the emulsion may consist of the mixture of the grains having various crystal forms. In the present invention, an emulsion preferably contains 50 % by weight or more, preferably 70 % by weight or more, and more preferably 90 % by weight or more of grains having a regular crystal shape.

In addition, an emulsion in which the tabular grains having an average aspect ratio (circle area-corresponding diameter/thickness) of 5 or more, preferably 8 or more share 50% or more based on the whole grains is also preferred.

The emulsion used in the present invention can be synthesized by the methods described in *Chimie et Phisique Photographique* written by P. Glafkides (published by Paul Montel Co., Ltd., 1967), *Photographic Emulsion Chemistry* written by G. F. Duffin (published by Focal Press Co., Ltd., 1966), and *Making and Coating Photographic Emulsion* written by V. L. Zelikman et al, (published by Focal Press Co., Ltd., 1964). That is, any of an acid method, a neutral method and an ammonia method may be employed. Any of a single jet method, a double jet method and the combination thereof may be used as the method for allowing a water soluble silver salt to react with a water soluble halide. A method in which the grains are formed under the presence of excessive silver ions (the so-called reverse mixing method) can also be employed. Furthermore, one example of the double jet method includes the method in which the pAg of the solution in which the silver halide grains are formed is maintained at a constant value, the so-called controlled double jet method. By this method, a silver halide emulsion having a regular crystal form and an almost uniform grain size can be obtained.

Various polyvalent metal ion impurities can be introduced into the silver halide emulsion used in the present invention for the purposes of improving sensitivity, reciprocity characteristics, temperature and humidity dependency in exposing, and latent image preservability in the course of an emulsion grain formation and a physical ripening. Examples of compounds which can be employed include the salts of cadmium, zinc, lead, copper, and thallium, and the salts or complex salts of iron, ruthenium, rhodium, palladium, osmium, iridium, and platinum, which are the elements of the VIII group. In particular, the VIII group elements are preferably used. The amount of these compounds added can be selected from a broad range according to the desired purposes and is preferably $10^{-9}$ to $10^{-2}$ mole per mole of silver halide. The silver halide emulsion used in the present invention is subjected to a chemical sensitization and a spectral sensitization.

For chemical sensitization, a sulfur sensitization represented by the addition of an unstable sulfur compound, a selenium sensitization, a noble metal sensitization represented by a gold sensitization, and a reduction sensitization, singly or in combination, can be employed.

The spectral sensitization is carried out for the purpose of providing those emulsions present in the respective layers of the light-sensitive material with a spectral sensitivity in the prescribed wavelength regions. In the present invention, a dye which absorbs a ray in the wavelength region corresponding to the desired spectral sensitivity, i.e., spectral sensitizing dye, is preferably added. Examples of suitable spectral sensitizing dye include the compounds described in *Heterocyclic Compounds—Cyanine Dyes and Related Compounds* written by F. M. Harmer (published by John Wiley & Sons, New York, London, 1964). Those described at the right upper column of the page 22 to the page 38 of JP-A-62-215272 are preferably used as the specific examples of the compound and the spectral sensitizing method.

Various compounds or precursors thereof can be incorporated into the silver halide emulsions of the present invention in order to prevent fog generated at a preparing step, during a storage or in the processing of a light-sensitive material, or stabilizing the photographic performances. The compounds described at the pages 39 to 72 of above JP-A-62-215272 can be used as specific examples of these compounds.

The emulsion used in the present invention may be either a so-called surface latent image type emulsion in which a latent image is formed mainly on a grain surface or a so-called inner latent image type emulsion in which the latent image is formed mainly in the inside of the grain.

Gelatin subjected to a deionization treatment is preferably used in the present invention. Gelatin usually contains a lot of calcium ions. For example, it can contain 5000 ppm or more in many cases. The deionized gelatin used in the present invention contains preferably the calcium ion of 500 ppm or less. The deionized gelatin is preferably used in the ratio of 10 % by weight or more, more preferably 20 % by weight or more, and particularly preferably 50 % by weight or more based on the whole gelatin. Such the gelatin may be employed in any layer.

A light-insensitive layer containing a UV absorbing agent is preferably provided on the emulsion layer farthest from the support of the silver halide color photographic material of the present invention. In this case, where this light-insensitive layer and/or the protective layer therefor contains hydroquinones, the total coated amount of hydroquinones in these layers is preferably 0.020 g/m$^2$ or less, more preferably 0.005 g/m$^2$ or less, and most preferably they are not contained at all. Thus, the term "is substantially free of hydroquinones" relates to the foregoing.

Moreover, compounds can be introduced in order to improve the sharpness of an image. For example, so that the optical reflection density of the light-sensitive material in 680 nm becomes 0.70 or more, the dyes (among them, an oxonol type dye) capable of being decolored by processing, described at pages 27 to 76 of European Patent Application 0 337 490 A2, can be incorporated into a hydrophilic colloid layer of the light-sensitive material. In addition, titanium oxide which is subjected to a surface treatment with di- to tetrahydric alcohols (for example, trimethylolethane) in the proportion of 12 % by weight or more (more preferably 14 % by weight or more) can be introduced into an anti-water resin layer of the support.

The photographic additives employed in the present invention, such as the cyan, magenta and yellow couplers are preferably dissolved in an organic high boiling organic solvent and used. Any organic high boiling organic solvents can be used as long as they are the compounds which have the melting point of 100° C. or less and the boiling point of 140° C. or more and which are immiscible with water and are the good solvents for the couplers. The organic high boiling organic solvent has preferably the melting point of 80° C. or less. It has preferably the boiling point of 160° C. or more, more preferably 170° C. or more.

The details of these organic high boiling organic solvents are described at the right lower column of the page 137 to the right upper column of the page 144 in JP-A-62-215272 which is incorporated by reference.

The cyan, magenta and yellow couplers can be impregnated in a loadable latex polymer (for example, U.S. Pat. No. 4,203,716) or dissolved together with a water insoluble and organic solvent soluble polymer under the presence or absence of the above organic high boiling organic solvent to emulsify and disperse them in a hydrophilic colloid aqueous solution.

Preferably used are the homopolymers or copolymers described at the 7 to 15 columns of U.S. Pat. No. 4,857,449 and at the pages of 12 to 30 of International Publication W088/00723 each of which are incorporated by reference. A methacrylate series or acrylamide series polymer, particularly an acrylamide series polymer is preferably used in terms of the stabilization of a dye image. Also, in the light-sensitive material according to the present invention, the color image preservability improving compounds described in European Patent EP 0 277 589 A2 are preferably used together with a coupler. In particular, they are used preferably in combination with a pyrazoloazole coupler.

The generation of stain due to the reaction of a color developing agent, or an oxidation product thereof, remaining in a layer during storage after processing with a coupler can be prevented through the use, singly or in combination, of compounds (F) which are chemically combined with an aromatic amine type developing agent remained after a color development processing to form a chemically inactive and substantially colorless compound, and/or compounds (G) which are chemically combined with the oxidation product of an aromatic amine type developing agent remained after a color development processing to form a chemically inactive and substantially colorless compound.

Further, the anti-mold agents described in JP-A-63-271247 are preferably added to the light-sensitive material according to the present invention for the purpose of preventing various molds and bacteria which grow in a hydrophilic colloid layer to deteriorate an image.

There may be used as a support for the light-sensitive material according to the present invention for display, a white color polyester series support or a support in which a layer containing a white pigment is provided on a support side having a silver halide emulsion layer. An anti-halation layer is preferably provided on a support side coated thereon with a silver halide emulsion layer or the backside thereof in order to further improve sharpness. In particular, the transmission density of a support is controlled preferably in the range of 0.35 to 0.8 so that a display can be admired with either a reflected light or a transmitted light.

The light-sensitive material according to the present invention may be exposed with either a visible ray or an infrared ray. An exposing manner may be either a low illuminance exposure or a high illuminance and short time exposure. Particularly in the latter case, preferred is a laser scanning exposing method in which the exposure time per picture element is less than $10^{-4}$ second.

In exposure, a band stop filter described in U.S. Pat. No. 4,880,726 is preferably used, whereby a light mixture is removed to notably improve a color reproduction.

The color photographic material according to the present invention is preferably subjected to the color development, bleach-fixing or bleaching and fixing, and washing (or a stabilizing treatment) treatments after an exposure. The bleaching and fixing may also be separately carried out as opposed to the single bath described above. The use of the color photographic material according to the present invention enables the processing from the color developing treatment to the washing treatment or the stabilizing treatment to be carried out within four minutes, more preferably within three minutes.

It is preferred that the color developing solution used in the present invention is substantially free of benzyl alcohol. The term "is substantially free of benzyl alcohol" means that the amount of benzyl alcohol in the color developing solution is preferably 1 ml/liter or less, more preferably 0.5 ml/liter or less, and most preferably is zero.

Those described in the following patent publications, each of which are incorporated by reference for all purposes, particularly European Patent Application 0 355 660 A2 (corresponding to JP-A-2-139544) are preferably used as the silver halide emulsions, other materials (the additives) and photographic constitutional layers (a layer arrangement) applied to the light-sensitive material according to the present invention, and the processing methods and additives for processing, which are applied for processing this light-sensitive material:

| Photographic Element | JP-A-62-215272 | JP-A 2-33144 | EP 0 355 660 A2 |
|---|---|---|---|
| Silver Halide Emulsions | From page 10, right upper column, line 6 to page 12, left lower column, line 5; and from page 12, right lower column, line 4 to page 13, left upper column, line 17 | From page 28, right upper column, line 16 to page 29, right lower column, line 11; and page 30, lines 2 to 5 | From page 45, line 53 to page 47, line 3; and page 47, lines 20 to 22 |

-continued

| Photographic Element | JP-A-62-215272 | JP-A 2-33144 | EP 0 355 660 A2 |
|---|---|---|---|
| Silver Halide Solvents | Page 12, left lower column, lines 6 to 14; and from page 13, left upper column, line 3 from below to page 18, left lower column, last line | — | — |
| Chemical Sensitizers | Page 12, from left lower column, line 3 from below to right lower column, line 5 from below; and from page 18, right lower column, line 1 to page 22, right upper column, line 9 from below | Page 29, right lower column, line 12 to last line | Page 47, lines 4 to 9 |
| Color Sensitizers (Color Sensitizing Methods) | From page 22, right upper column, line 8 from below to page 38, last line | Page 30, left upper column, lines 1 to 13 | Page 47, lines 10 to 15 |
| Emulsion Stabilizers | From page 39, left upper column, line 1 to page 72, right upper column, last line | Page 30, from left upper column, line 14 to right upper column, line 1 | Page 47, lines 16 to 19 |
| Development Promoters | From page 72, left lower column, line 1 to page 91, right upper column, line 3 | — | — |
| Color Couplers (Cyan, Magenta and Yellow Couplers) | From page 91, right upper column, line 4 to page 121, left upper column, line 6 | From page 3, right upper column, line 14 to page 18, left upper column, last line; and from page 30, right upper column, line 6 to page 35, right lower column, line 11 | Page 4, lines 15 to 27; from page 5, line 30 to page 28, last line; page 45, lines 29 to 31; and from page 47, line 23 to page 63, line 50 |
| Coloring Enhancers | From page 121, left lower column, line 7 to page 125, right upper column, line 1 | — | — |
| Ultraviolet Absorbents | From page 125, right upper column, line 2 to page 127, left lower column, last line | From page 37, right lower column, line 14 to page 38, left upper column, line 11 | Page 65, lines 22 to 31 |
| Anti-Fading Agents (Color Image Stabilizers) | From page 127, right lower column, line 1 to page 137, left lower column, line 8 | From page 36, right upper column, line 12 to page 37, left upper column, line 19 | From page 4, line 30 to page 5, line 23; from page 29, line 1 to page 45, line 25; page 45, lines 33 to 40; and page 65, lines 2 to 21 |
| High Boiling Point and/or Low Boiling Point Organic Solvents | From page 137, left lower column, line 9 to page 144, right upper column, last line | From page 35, right lower column, line 14 to page 36, left upper column, line 4 from below | Page 64, lines 1 to 51 |
| Dispersing Methods of Photographic Additives | From page 144, left lower column, line 1 to page 146, right upper column, line 7 | From page 27, right lower column, line 10 to page 28, left upper column, last line; and from page 35, right lower column, line 12, to page 36, right upper column, line 7 | From page 63, line 51 to page 64, line 56 |
| Hardening Agents | From page 146, right upper column, line 8 to page 155, left lower column, line 4 | — | — |
| Developing Agent Precursors | Page 155, from left lower column, line 5 to right lower column, line 2 | — | — |
| Development Inhibitor Releasing Compounds | Page 155, right lower column, lines 3 to 9 | — | — |
| Supports | From page 155, right lower column, line 19 to page 156, left upper column, line 14 | From page 38, right upper column, line 18 to page 39, left upper column, line 3 | From page 66, line 29 to page 67, line 13 |
| Constitution of Photographic Layers | Page 156, from left upper column, line 15 to right lower column, line 14 | Page 28, right upper column, lines 1 to 15 | Page 45, lines 41 to 52 |
| Dyes | From page 156, right lower column, line 15 to page 184, right lower column, last line | Page 38, from left upper column, line 12 to right upper column, line 7 | Page 66, lines 18 to 22 |
| Color Mixing Preventing Agents | From page 185, left upper column, line 1 to page 188, right lower column, line 3 | Page 36, right upper column, lines 8 to 11 | From page 64, line 57 to page 65, line 1 |
| Gradation Adjusting Agents | Page 188, right lower column, lines 4 to 8 | — | — |
| Stain Inhibitors | From page 188, right lower column, line 9 to page 193, right lower column, line 10 | Page 37, from left upper column, last line to right lower column, line 13 | From page 65, line 32 to page 66, line 17 |
| Surfactants | From page 201, left lower column, line 1 to page 210, right upper column, last one | From page 18, right upper column, line 1 to page 24, right lower column, last line; and page 27, from left lower column, line 10 from below to right lower column, line 9 | — |

-continued

| Photographic Element | JP-A-62-215272 | JP-A 2-33144 | EP 0 355 660 A2 |
|---|---|---|---|
| Fluorine-Containing Compounds (as antistatic agents, coating aids, lubricants, and anti-blocking agents) | From page 210, left lower column, line 1 to page 222, left lower column, line 5 | From page 25, left upper column, line 1 to page 27, right upper column, line 9 | — |
| Binders (hydrophilic colloids) | From page 222, left lower column, line 6 to page 225, left upper column, last line | Page 38, right upper column, lines 8 to 18 | Page 66, lines 23 to 28 |
| Tackifiers | From page 225, right upper column, line 1 to page 227, right upper column, line 2 | — | — |
| Antistatic Agents | From page 227, right upper column, line 3 to page 230, left upper column, line 1 | — | — |
| Polymer Latexes | From page 230, left upper column, line 2 to page 239, last line | — | — |
| Mat Agents | Page 240, from left upper column, line 1 to right upper column, last line | — | — |

The citation to JP-A-62-215272 includes the letter of amendment filed on March 16, 1987.

Of the above-mentioned color couplers, the so-called shorwave type yellow couplers as described in JP-A-63-231451, JP-A-63-123047, JP-A-63-241547, JP-A-1-173499, JP-A-1-213648 and JP-A-1-250944 are also preferably used as yellow couplers.

In addition, the diphenylimidazole series cyan couplers described in JP-A-2-33144, the 3-hydroxypyridine series cyan couplers described in European Patent Application 0 333 185 A2 (of them, particularly preferred are coupler (42), which is prepared by providing a tetra-equivalent coupler with a chlorine splitting group to convert it to a divalent coupler, and the couplers (6) and (9)), and the cyclic active methylene series cyan couplers (of them, particularly preferred are the couplers 3, 8 and 34) may be employed as a cyan coupler.

The method described in a left upper column at page 27 to a light upper column at page 34 of JP-A-2-207250 can be preferably applied as a method for processing a silver halide color light-sensitive material in which a high silver chloride emulsion having a silver chloride content of 90 mole % or more is used.

EXAMPLES

Example 1

A paper support laminated on the both sides thereof with polyethylene, which was subjected to a corona discharge treatment, was provided with a gelatin subbing layer containing sodium dodecylbenzenesulfonate and further was coated with the various photographic constitutional layers, whereby a multilayered color photographic paper (Sample 101) having the following layer constitution was prepared. The coating solutions were prepared in the following manner.

Preparation of the first layer coating solution

A yellow coupler (ExY) 153.0 g, a dye image stabilizer (Cpd-1) 15.0 g, a dye image stabilizer (Cpd-2) 7.5 g, and a dye image stabilizer (Cpd-3) 16.0 g were dissolved in a first solvent (Solv-1) 25 g, a second solvent (Solv-2) 25 g and ethyl acetate 180 ml, and this solution was dispersed in a 10% gelatin aqueous solution 1000 g containing a 10% sodium dodecylbenzenesulfonate aqueous solution 60 ml and citric acid 10 g, to thereby prepare an emulsified dispersion A.

Meanwhile, a silver chlorobromide emulsion A (cube, a 3:7 mixture (Ag mole ratio) from the large size emulsion A with the average grain size of 0.88 μm and the small size emulsion A with the average grain size of 0.70 μm, wherein the fluctuation coefficients in the grain size distributions were 0.08 and 0.10, respectively, and either size emulsions contained the grains in which silver bromide 0.3 mol % was localized on a part of the surface thereof) was prepared. Added to this emulsion were the following blue-sensitive sensitizing dyes A and B each of $2.0\times10^{-4}$ mole per mole of silver to the large size emulsion A and each of $2.5\times10^{-4}$ mole per mole of silver to the small size emulsion A. Further, this emulsion was subjected to a chemical ripening after adding a sulfur sensitizer and a gold sensitizer. The foregoing emulsified dispersion A and this silver chlorobromide emulsion A were mixed and dissolved, whereby the first layer coating solution having the following composition was prepared.

The coating solutions for the 2nd layer to the 7th layer were prepared in the same manner as the 1st layer coating solution. Sodium 1-oxy-3,5-dichloro-s-triazine was used as the hardener for the respective layers. Further, Cpd-14 and Cpd-15 were added to the respective layers so that the whole amounts thereof became 25.0 mg/m² and 50.0 mg/m², respectively.

The following spectral sensitizing dyes were used for the silver chlorobromide emulsions contained in the respective light-sensitive emulsion layers.

Blue-sensitive emulsion layer

Sensitizing dye A

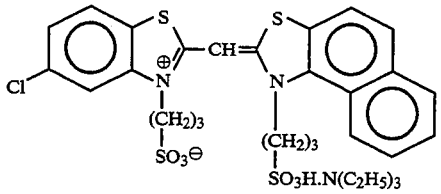

Sensitizing dye B

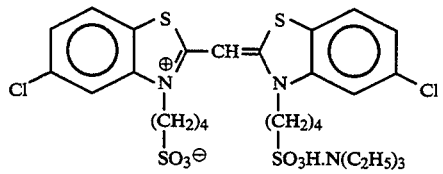

(each $2.0\times10^{-4}$ mole per mole of silver halide to the large size emulsion and each $2.5\times10^{-4}$ mole per mole of silver halide to the small size emulsion).

Green-sensitive emulsion layer

Sensitizing dye C

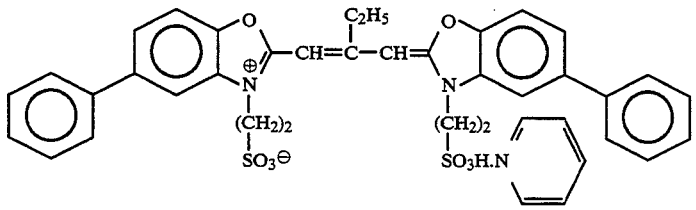

($4.0\times10^{-4}$ mole per mole of silver halide to the large size emulsion and $5.6\times10^{-4}$ mole per mole of silver halide to the small size emulsion ), and Sensitizing dye D

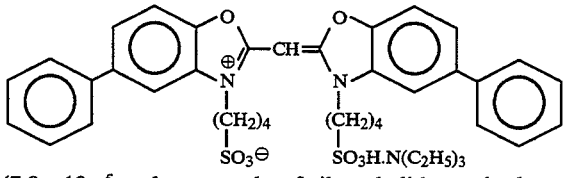

($7.0\times10^{-5}$ mole per mole of silver halide to the large size emulsion and $1.0\times10^{-5}$ mole per mole of silver halide to the small size emulsion).

Red-sensitive emulsion layer

Sensitizing dye E

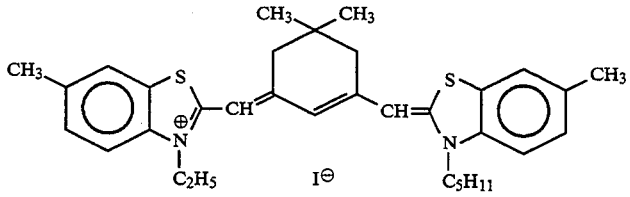

($0.9\times10^{-4}$ mole per mole of silver halide to the large size emulsion and $1.1\times10^{-4}$ mole per mole of silver halide to the small size emulsion).

Further, the following compound was added in an amount of $2.6\times10^{-3}$ mole per mole of silver halide:

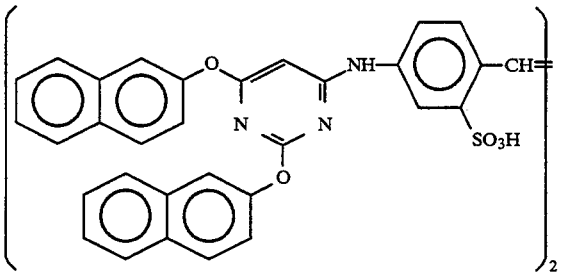

Further added to the blue-sensitive layer, green-sensitive layer and red-sensitive layer, 1-(5-methylureidophenyl)-5-mercaptotetrazole in the amounts of $8.5\times10^{-5}$ mole, $7.7\times10^{-4}$ mole and $2.5\times10^{-4}$ mole per mole of silver halide, respectively.

Further added to the blue-sensitive layer and green-sensitive layer, 4-hydroxy-6-methyl-1,3,3a,7-tetrazaindene in the amounts of $1\times10^{-4}$ mole and $2\times10^{-4}$ mole per mole of silver halide, respectively.

The following dye (the numeral in a parenthesis represents a coated amount) was added to an emulsion layer for preventing an irradiation:

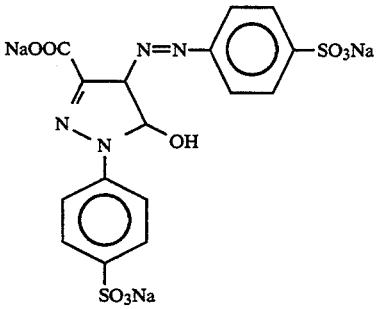

(10 mg/m²)

-continued

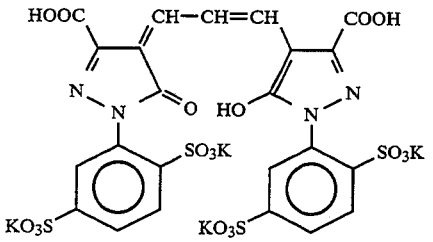

(10 mg/m²)

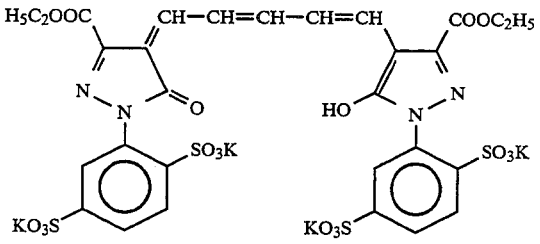

(40 mg/m²)

and

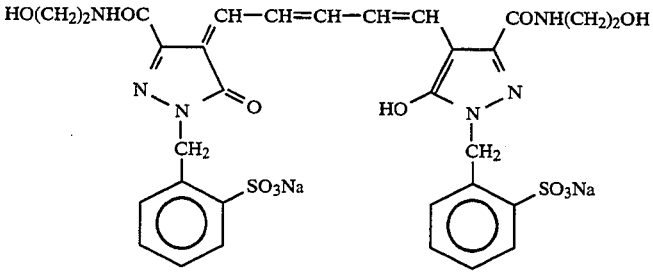

(20 mg/m²)

Layer constitution

The compositions of the respective layers are shown below. The numerals represent the coated amounts (g/m²). The coated amounts of the silver halide emulsions are expressed in terms of the amounts converted to silver.

| | |
|---|---|
| Support: | |
| Polyethylene laminated paper (polyethylene coated on the first layer side contains a white pigment/$TiO_2$ and a blue dye/ultramarine). | |
| First layer: a blue-sensitive emulsion layer | |
| Above silver chlorobromide emulsion A | 0.27 |
| Gelatin | 1.36 |
| Yellow coupler (ExY) | 0.67 |
| Dye image stabilizer (Cpd-1) | 0.08 |
| Dye image stabilizer (Cpd-2) | 0.04 |
| Dye image stabilizer (Cpd-3) | 0.08 |
| Solvent (Solv-1) | 0.12 |
| Solvent (Solv-2) | 0.12 |
| Second layer: an anti-color mixing layer | |
| Gelatin | 1.10 |
| Anti-color mixing agent (Cpd-4) | 0.08 |
| Solvent (Solv-2) | 0.53 |
| Dye image stabilizer (Cpd-7) | 0.03 |
| Third layer: a green-sensitive emulsion layer | |
| Silver chlorobromide emulsion (cube; 1:3 mixture (silver mole ratio) of the large size emulsion B having the average grain size of 0.55 μm and the small size emulsion B having the average grain size of 0.39 μm, wherein the fluctuation coefficients of the grain size distributions are 0.10 and 0.08, respectively, and either size emulsions contain the grains in which AgBr 0.8 mol % is localized on a part of the surface thereof) | 0.13 |
| Gelatin | 1.45 |

-continued

| | |
|---|---|
| Magenta coupler (ExM) | 0.16 |
| Dye image stabilizer (Cpd-5) | 0.15 |
| Dye image stabilizer (Cpd-2) | 0.03 |
| Dye image stabilizer (Cpd-6) | 0.02 |
| Dye image stabilizer (Cpd-8) | 0.08 |
| Solvent (Solv-3) | 0.50 |
| Solvent (Solv-4) | 0.15 |
| Solvent (Solv-5) | 0.15 |
| Fourth layer: an anti-color mixing layer | |
| Gelatin | 0.70 |
| Anti-color mixing agent (Cpd-4) | 0.05 |
| Solvent (Solv-2) | 0.37 |
| Dye image stabilizer (Cpd-7) | 0.02 |
| Fifth layer: a red-sensitive emulsion layer | |
| Silver chlorobromide emulsion (cube; 1:4 mixture (silver mole ratio) of the large size emulsion C having the average grain size of 0.50 μm and the small size emulsion C having the average grain size of 0.41 μm, wherein the fluctuation coefficients of the grain size distributions are 0.09 and 0.11, respectively, and either size emulsions contain the grains in which AgBr 0.8 mol % is localized on a part of the surface thereof) | 0.20 |
| Gelatin | 0.90 |
| Cyan coupler (ExC) | 0.33 |
| UV absorber (UV-2) | 0.18 |
| Dye image stabilizer (Cpd-9) | 0.15 |
| Dye image stabilizer (Cpd-10) | 0.15 |
| Dye image stabilizer (Cpd-11) | 0.01 |
| Solvent (Solv-6) | 0.22 |
| Dye image stabilizer (Cpd-8) | 0.01 |
| Dye image stabilizer (Cpd-6) | 0.01 |
| Solvent (Solv-1) | 0.01 |
| Dye image stabilizer (Cpd-1) | 0.33 |
| Sixth layer: a UV absorbing layer | |
| Gelatin | 0.55 |
| UV absorber (UV-1) | 0.38 |

-continued

| | |
|---|---|
| Dye image stabilizer (Cpd-12) | 0.15 |
| Dye image stabilizer (Cpd-5) | 0.02 |
| Seventh layer: a protective layer | |
| Gelatin | 1.33 |
| Acryl-modified copolymer of polyvinyl alcohol | 0.05 |

-continued

| | |
|---|---|
| (a modification degree: 17%) | |
| Liquid paraffin | 0.02 |
| Dye image stabilizer (Cpd-13) | 0.01 |

The compounds used are shown below:

(ExY) Yellow coupler

1:1 mixture (molar ratio) of

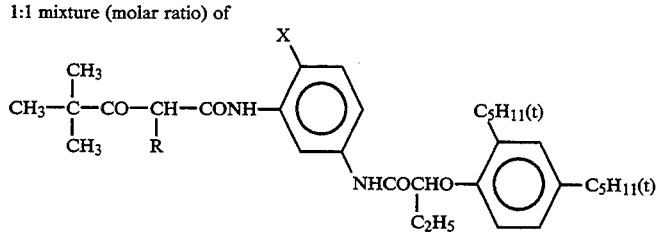

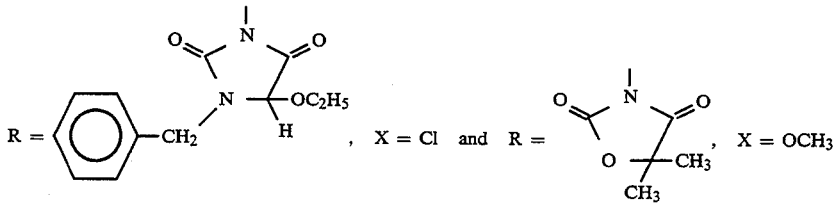

(ExM) magenta coupler

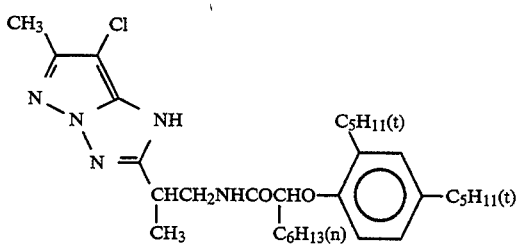

(ExC) Cyan coupler

3:7 mixture (molar ratio) of

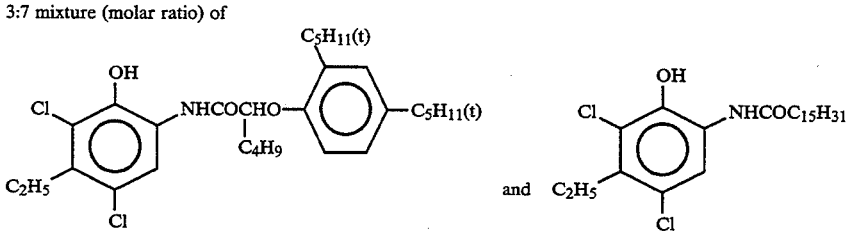

(Cpd-1) Dye image stabilizer

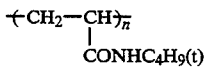

Average molecular weight: 60,000

(Cpd-2) Dye image stabilizer

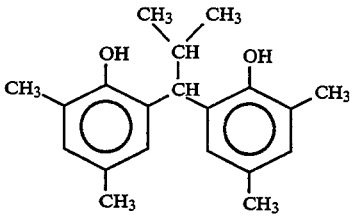

(Cpd-3) Dye image stabilizer

-continued
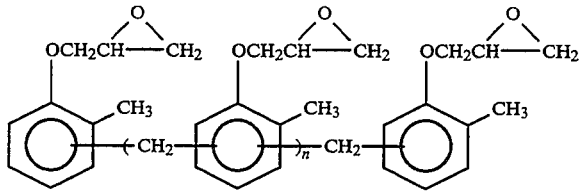
n = 7–8 (average value)
(Cpd-4) Anti-color mixing agent
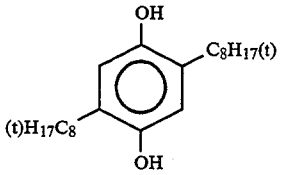
(Cpd-5) Dye image stabilizer
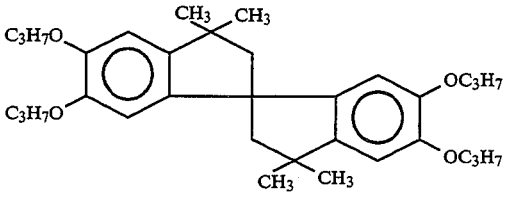
(Cpd-6) Dye image stabilizer
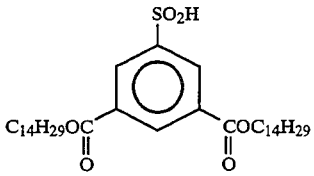
(Cpd-7) Dye image stabilizer
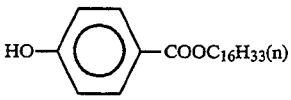
(Cpd-8) Dye image stabilizer
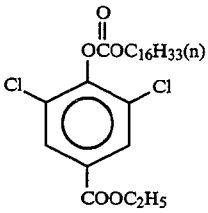
(Cpd-9) Dye image stabilizer
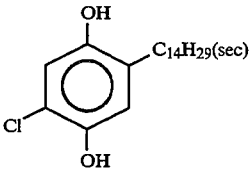
(Cpd-10) Dye image stabilizer -continued
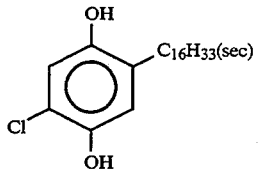
(Cpd-11) Dye image stabilizer
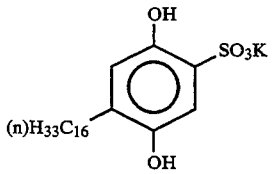
(Cpd-12) Dye image stabilizer
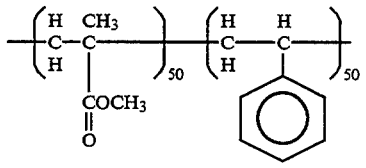
Average molecular weight: about $6.0 \times 10^4$
(Cpd-13) Dye image stabilizer
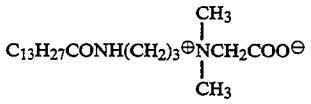
(Cpd-14) Antiseptic
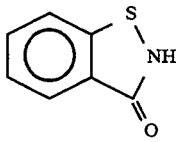
(Cpd-15) Antiseptic
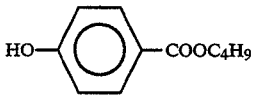
(UV-1) UV-absorber
(1)
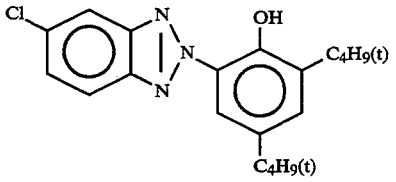
(2)
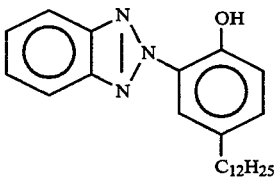
(3)
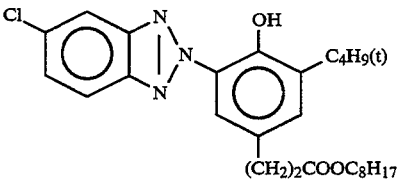
(4)
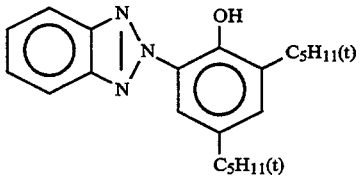
Mixture of (1), (2), (3) and (4) by 10:5:1:5 (weight ratio)
(UV-2) UV absorber -continued (1)

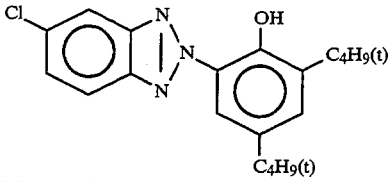

(2)

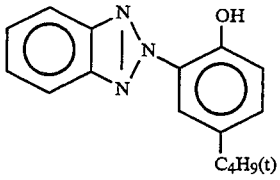

(3)

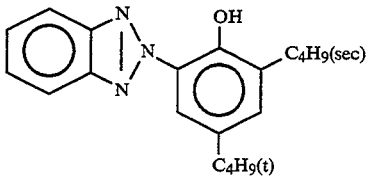

Mixture of (1), (2) and (3) by 1:2:2 (weight ratio)

(Solv-1) Solvent

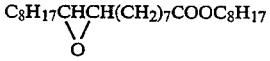

(Solv-2) Solvent

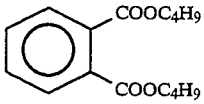

(Solv-3) Solvent

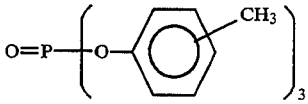

(Solv-4) Solvent

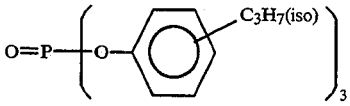

(Solv-5) Solvent

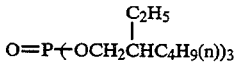

(Solv-6) Solvent

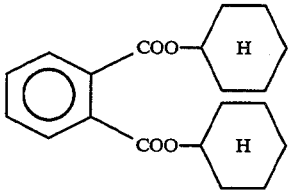

Next, Samples 102 to 143 were prepared in the same manner as Sample 101 except that the compositions of the second layer, third layer and fourth layer were changed as shown in Table-A. The magenta coupler was replaced in the same molar amount. The anti-color mixing agent was replaced in the same molar amount.

First, Sample 101 was subjected to a gradational exposure of three color separation for a sensitometry with a sensitometer (FWH type, the color temperature of a light source: 3200° K., manufactured by Fuji Photo Film Co., Ltd.), wherein the exposure was given so that an exposure became 250 CMS at an exposing time of 0.1 second.

The following processing steps and processing solutions of the following compositions were used to subject a standard sample to a continuous processing with a paper processing machine, whereby the development processing solution in a running equilibrium status was prepared. This development processing solution in the running equilibrium status was used to process above exposed Samples 101 to 143 according to the following processing steps.

| Processing step | Temperature | Time | Replenishing amount* | Tank capacity |
|---|---|---|---|---|
| Color developing | 35° C. | 45 seconds | 161 ml | 17 liter |
| Bleach/fixing | 30 to 35° C. | 45 seconds | 215 ml | 17 liter |
| Rinsing | 30° C. | 90 seconds | 350 ml | 10 liter |
| Drying | 70 to 80° C. | 60 seconds | | |

*Replenishing amount is per $m^2$ of the light-sensitive material.

The compositions of the respective processing solutions are as follows:

| | Tank solution | Replenishing solution |
|---|---|---|
| | Color developing solution | |
| Water | 800 ml | 800 ml |
| Ethylenediamine-N,N,N',N'-tetramethylene phosphonic acid | 1.5 g | 2.0 g |
| Potassium bromide | 0.015 g | — |
| Triethanolamine | 8.0 g | 12.0 g |
| Sodium chloride | 1.4 g | — |
| Potassium carbonate | 25 g | 25 g |
| N-ethyl-N-(β-methanesulfonamidethyl)-3-methyl-4-aminoaniline sulfate | 5.0 g | 7.0 g |
| N,N-bis(carboxymethyl) hydrazine | 4.0 g | 5.0 g |
| Fluorescent whitening agent (WHITEX 4B manufactured by Sumitomo Chemical Co., Ltd.)) | 1.0 g | 2.0 g |
| Water was added to | 1000 ml | 1000 ml |
| pH (25° C.) | 10.05 | 10.45 |
| Bleach/fixing solution (Common to the tank solution and replenishing solution) | | |
| Water | 400 ml | |
| Ammonium thiosulfate (700 g/liter) | 100 ml | |
| Sodium sulfite | 17 g | |
| Iron (III) ammonium ethylenediaminetetraacetate | 55 g | |
| Disodium ethylenediaminetetraacetate | 5 g | |

-continued

| | Tank solution | Replenishing solution |
|---|---|---|
| | Color developing solution | |
| Ammonium bromide | 40 g | |
| Water was added to | 1000 ml | |
| pH (25° C.) | 6.0 | |
| Rinsing solution (Common to the tank solution and replenishing solution) | | |
| Deionized water (contents of calcium and magnesium: each 3 ppm or lower) | | |

Next, in order to evaluate the dye images of the respective samples, a light fading test was carried out at the following different two conditions for a humidity to measure a fading rate of magenta at the initial density of 1.5.

Condition (A)

The fading test was carried out with a fade meter of xenon 100,000 lux at a room temperature and the relative humidity of about 20 % for 20 days.

Condition (B)

The fading test was carried out with a fade meter of xenon 100,000 lux at a room temperature and the relative humidity of about 90 % for 20 days.

The results thereof are shown in Table-A.

TABLE A

| Sample No. | 3rd layer Magenta coupler | 2nd layer Anti-color mixing agent | 4th layer Anti-color mixing agent | Light fastness Condition A | Light fastness Condition B |
|---|---|---|---|---|---|
| 101 (Comp.) | I-7 | HQ-1 (Comp.) | HQ-1 (Comp.) | 31 | 48 |
| 102 (Comp.) | I-7 | HQ-2 (Comp.) | HQ-2 (Comp.) | 41 | 59 |
| 103 (Comp.) | I-7 | HQ-3 (Comp.) | HQ-3 (Comp.) | 42 | 62 |
| 104 (Comp.) | I-7 | HQ-2 (Comp.) | HQ-1 (Comp.) | 36 | 55 |
| 105 (Comp.) | I-7 | HQ-3 (Comp.) | HQ-1 (Comp.) | 37 | 64 |
| 106 (Comp.) | I-7 | HQ-1 (Comp.) | HQ-2 (Comp.) | 38 | 56 |
| 107 (Comp.) | I-1 | HQ-1 (Comp.) | HQ-1 (Comp.) | 27 | 47 |
| 108 (Comp.) | I-1 | HQ-2 (Comp.) | HQ-2 (Comp.) | 28 | 57 |
| 109 (Comp.) | I-1 | HQ-1 (Comp.) | HQ-2 (Comp.) | 31 | 50 |
| 110 (Comp.) | I-1 | HQ-3 (Comp.) | HQ-3 (Comp.) | 37 | 60 |
| 111 (Comp.) | I-7 | HQ-1 (Comp.) | II-1 | 27 | 46 |
| 112 (Comp.) | I-7 | II-1 | HQ-1 (Comp.) | 26 | 46 |
| 113 (Comp.) | I-1 | HQ-2 (Comp.) | II-3 | 34 | 57 |
| 114 (Comp.) | I-1 | II-3 | HQ-1 (Comp.) | 35 | 55 |
| 115 (Comp.) | I-1 | HQ-3 (Comp.) | II-5 | 37 | 56 |
| 116 (Comp.) | I-9 | HQ-1 (Comp.) | II-20 | 40 | 59 |
| 117 (Comp.) | MM-1 | HQ-1 (Comp.) | HQ-1 (Comp.) | 48 | 50 |
| 118 (Comp.) | MM-1 | II-1 | II-1 | 47 | 53 |
| 119 (Comp.) | MM-1 | II-3 | II-3 | 48 | 54 |
| 120 (Comp.) | MM-1 | II-4 | II-4 | 48 | 53 |
| 121 (Inv.) | I-7 | II-1 | II-1 | 27 | 27 |
| 122 (Inv.) | I-7 | II-3 | II-3 | 27 | 28 |
| 123 (Inv.) | I-7 | II-4 | II-4 | 29 | 31 |
| 124 (Inv.) | I-7 | II-5 | II-5 | 27 | 28 |
| 125 (Inv.) | I-7 | II-9 | II-9 | 29 | 31 |
| 126 (Inv.) | I-7 | II-11 | II-11 | 29 | 31 |
| 127 (Inv.) | I-7 | II-22 | II-22 | 27 | 28 |
| 128 (Inv.) | I-7 | II-30 | II-30 | 27 | 29 |
| 129 (Inv.) | I-1 | II-1 | II-1 | 26 | 28 |
| 130 (Inv.) | I-1 | II-3 | II-3 | 27 | 29 |
| 131 (Inv.) | I-1 | II-4 | II-4 | 29 | 31 |
| 132 (Inv.) | I-1 | II-5 | II-1 | 26 | 27 |
| 133 (Inv.) | I-2 | II-1 | II-1 | 27 | 28 |
| 134 (Inv.) | I-2 | II-4 | II-4 | 29 | 32 |
| 135 (Inv.) | I-14 | II-1 | II-1 | 25 | 25 |
| 136 (Inv.) | I-14 | II-3 | II-3 | 25 | 25 |
| 137 (Inv.) | I-14 | II-4 | II-4 | 25 | 26 |
| 138 (Inv.) | I-3 | II-20 | II-20 | 27 | 28 |
| 139 (Inv.) | I-5 | II-1 | II-1 | 26 | 28 |
| 140 (Inv.) | I-14 | II-4 | II-4 | 27 | 27 |

TABLE A-continued

| Sample No. | 3rd layer Magenta coupler | 2nd layer Anti-color mixing agent | 4th layer Anti-color mixing agent | Light fastness Condition A | Light fastness Condition B |
|---|---|---|---|---|---|
| 141 (Inv.) | I-7 | II-9 | II-1 | 27 | 27 |
| 142 (Inv.) | I-7 | II-1 | II-4 | 26 | 27 |
| 143 (Inv.) | I-21 | II-4 | II-1 | 31 | 31 |

Comparative compounds

HQ-1

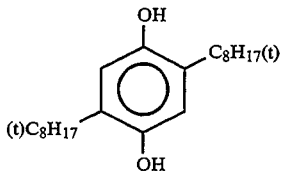

M.W. = 334.6

HQ-2

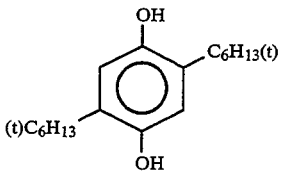

M.W. = 278.4

HQ-3

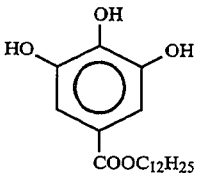

M.W. = 338.4

Comparative magenta coupler

MM-1

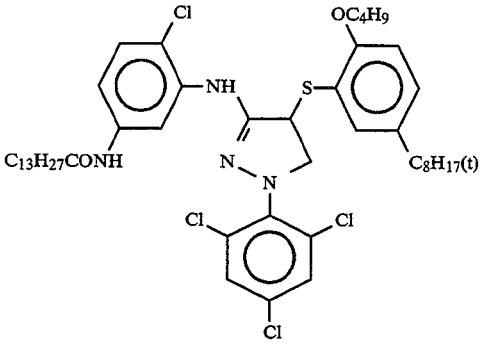

The results shown in Table-A illustrate that the sample according to the present invention (Samples 121 to 143), have an excellent light fastness under both conditions of low humidity and high humidity and that the difference between the light fastnesses at such conditions is small (i.e., a humidity dependency is small).

Meanwhile, it also illustrates that the light fastnesses in the comparative samples (Samples 101 to 116) in which the anti-color mixing agents outside the present invention were used are notably inferior particularly in the fading under the high humidity to those in the samples of the present invention.

In those samples where the magenta couplers outside the present invention were used (Samples 117 to 120), it can be seen that the humidity dependency in the light fastness is certainly small regardless of the kind of the anti-color mixing agent but the light fastnesses thereof are inferior to those of the samples of the present invention at every humidity condition.

Example 2

Samples 201 to 223 were prepared in the same manner as Sample 101 in Example 1 except that the anti-color mixing agent and organic high boiling organic agent contained in the second layer and fourth layer were changed as shown in Table-B (the anti-color mixing agent was replaced in the same mole and the organic high boiling organic agent was replaced in the same weight).

The samples were subjected to the exposure and development processing in the same manner as in Example 1 and then to the measurement of the color mixing and light fastness.

The degree of the color mixing was determined in the following manner. That is, the magenta density at the portion at which the yellow density at a processed blue light-exposed portion (that is, a yellow color developed portion) was 2.0, was measured to determine the degree of the color mixing, wherein the magenta density (in this case, 0.33) attributable to the sub-absorption of a yellow dye was subtracted from the above magenta density, whereby the degree of the color mixing ($\Delta D_G$) was obtained. Accordingly, where no color mixing was involved, $\Delta D_G$ is 0.00.

The light fastness was evaluated in the same manner as in Example 1.

The results thereof are shown in Table-B.

TABLE B

| Sample No. | 2nd layer and 4th layer Anti-color mixing agent | High boiling organic solvent Kind | High boiling organic solvent Dielectric constant | Degree of color mixing $\Delta D_G$ | Light fastness Condition A | Light fastness Condition B |
|---|---|---|---|---|---|---|
| 201 (Comp.) | HQ-1 (Comp.) | IV-2 | 6.5 | 0.01 | 31 | 48 |
| 202 (Comp.) | HQ-1 (Comp.) | IV-8 | 4.6 | 0.12 | 33 | 60 |
| 203 (Comp.) | HQ-1 (Comp.) | III-6 | 7.7 | 0.00 | 31 | 48 |
| 204 (Comp.) | HQ-1 (Comp.) | III-5 | 4.2 | 0.15 | 34 | 62 |
| 205 (Comp.) | HQ-1 (Comp.) | III-7 | 7.3 | 0.01 | 34 | 49 |
| 206 (Comp.) | HQ-1 (Comp.) | III-10 | 5.2 | 0.03 | 33 | 55 |
| 207 (Comp.) | HQ-1 (Comp.) | V-1 | 13.1 | 0.01 | 31 | 48 |
| 208 (Inv.) | II-1 | IV-2 | 6.5 | 0.00 | 26 | 28 |
| 209 (Comp.) | II-1 | IV-8 | 4.6 | 0.09 | 28 | 31 |
| 210 (Inv.) | II-1 | III-6 | 7.7 | 0.00 | 26 | 28 |
| 211 (Comp.) | II-1 | III-5 | 4.2 | 0.10 | 28 | 32 |
| 212 (Inv.) | II-1 | III-7 | 7.3 | 0.00 | 26 | 27 |
| 213 (Inv.) | II-1 | III-10 | 5.2 | 0.02 | 29 | 31 |

TABLE B-continued

| Sample No. | 2nd layer and 4th layer: Anti-color mixing agent | High boiling organic solvent: Kind | High boiling organic solvent: Dielectric constant | Degree of color mixing $\Delta D_G$ | Light fastness: Condition A | Light fastness: Condition B |
|---|---|---|---|---|---|---|
| 214 (Inv.) | II-1 | V-1 | 13.1 | 0.00 | 27 | 28 |
| 215 (Inv.) | II-4 | IV-2 | 6.5 | 0.00 | 29 | 30 |
| 216 (Comp.) | II-5 | IV-8 | 4.6 | 0.08 | 30 | 34 |
| 217 (Comp.) | II-14 | III-5 | 4.2 | 0.07 | 31 | 34 |
| 218 (Inv.) | II-30 | IV-2 | 6.5 | 0.00 | 26 | 28 |
| 219 (Inv.) | II-22 | III-7 | 7.3 | 0.00 | 26 | 28 |
| 220 (Inv.) | II-30 | V-2 | 13.1 | 0.00 | 27 | 29 |
| 221 (Inv.) | II-3 | V1-2 | 6.5 | 0.01 | 26 | 28 |
| 222 (Comp.) | II-3 | VI-8 | 4.6 | 0.10 | 28 | 31 |
| 223 (Comp.) | II-3 | — | — | 0.05 | 28 | 29 |

Samples 208, 210, 212 to 215, and 218 to 221 employ a high boiling organic solvent accoring to the present invention As can be seen from the results shown in Table-B, the use of the anti-color mixing agent of the present invention and the organic high boiling organic solvent having the dielectric constant of 5.0 or more (in particular 6.0 or more) provides the excellent color mixing and light fastness.

Example 3

Sample 301, which was the same as Sample 208 in Example 2, was prepared. Next, Samples 302 to 316 were prepared in the same manner as Sample 301 except that the hydroquinone compounds were added to the sixth layer and seventh layer as shown in Table-C.

The samples thus prepared were subjected to the exposure and development processing in the same manner as in Example 1 and then to the evaluation of the light fastness.

The results thereof are shown in Table-C.

TABLE C

| Sample No. | 6th layer Hydroquinone compound: Kind | 6th layer: Coated amount ($mg/m^2$) | 7th layer Hydroquinone compound: Kind | 7th layer: Coated amount ($mg/m^2$) | Light Fastness: Condition A | Light Fastness: Condition B |
|---|---|---|---|---|---|---|
| 301 | — | — | — | — | 26 | 28 |
| 302 | HQ-1 | 25 | — | — | 28 | 35 |
| 303 | HQ-1 | 30 | — | — | 30 | 38 |
| 304 | HQ-1 | 40 | — | — | 32 | 46 |
| 305 | — | — | HQ-1 | 25 | 28 | 34 |
| 306 | — | — | HQ-1 | 30 | 30 | 38 |
| 307 | — | — | HQ-1 | 40 | 34 | 44 |
| 308 | HQ-1 | 20 | HQ-1 | 20 | 31 | 46 |
| 309 | II-1 | 40 | — | — | 31 | 44 |
| 310 | II-2 | 40 | — | — | 32 | 47 |
| 311 | II-5 | 40 | — | — | 30 | 46 |
| 312 | — | — | II-1 | 25 | 27 | 37 |
| 313 | — | — | II-2 | 25 | 29 | 39 |
| 314 | — | — | II-5 | 25 | 30 | 40 |
| 315 | II-2 | 20 | II-2 | 20 | 31 | 42 |
| 316 | II-2 | 40 | II-2 | 20 | 33 | 54 |

As can be seen from the results shown in Table-C the effect of the present invention is markedly demonstrated particularly in those samples where hydroquinone compounds are not incorporated into the sixth layer and seventh layer.

In the interest of brevity and preciseness, the contents of the aforementioned numerous patents and articles are hereby incorporated by reference.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support having provided thereon (A) at least three silver halide emulsion layers each containing at least one different coupler for forming a different dye by a coupling reaction with the oxidation product of an aromatic primary amine developing agent and each having a different light sensitivity, and (B) at least one light-insensitive anti-color mixing layer provided between each of said silver halide emulsion layers, wherein at least one of said silver halide emulsion layers contains silver halide grains having a silver chloride content of 90 mole % or more and a magenta coupler represented by the following formula (I) and each of at least two of the anti-color mixing layers contains at least one anti-color mixing agent having a molecular weight of 350 or more and at least one high boiling organic solvent having the dielectric constant of 5.0 or more:

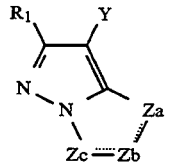

(I)

wherein $R_1$ represents a hydrogen atom or a substituent; $Z_a$, $Z_b$, and $Z_c$ each represent methine, substituted methine, =N—, or —NH—; Y represents a hydrogen atom or a group capable of splitting off upon a coupling reaction with the oxidation product of a developing agent; provided that a dimer or polymer may be formed via $R_1$, Y or $Z_a$, $Z_b$ or $Z_c$ each of which is a substituted methine.

2. The silver halide color photographic material as in claim 1, wherein said anti-color mixing agent having the molecular weight of 350 or more is represented by the following formula (II):

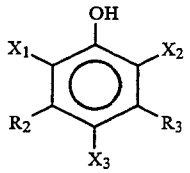

(II)

wherein $X_1$, $X_2$, $X_3$, $R_2$ and $R_3$ each represent a hydrogen atom or a substituent; at least one of $X^1$, $X_2$ and $X_3$ represents a hydroxy group or a sulfonamide group; provided that $X_1$, $X_2$, $X_3$, $R_2$ and $R_3$ are selected so that the molecular weight of said anti-color mixing agent becomes 350 or more; the groups which are present at an ortho position each other may be combined with each other to form a ring; and the compound represented by formula (II) may be combined via any of $X_1$, $X_2$, $X_3$, $R_2$ and $R_3$ with a polymer chain or combined with another compound of formula (II) to form a dimer or polymer.

3. The silver halide color photographic material as in claim 1, wherein said anti-color mixing layer contains at least one high boiling organic solvent having the dielectric constant of 6.0 or more.

4. The silver halide color photographic material as in claim 1, wherein a light-insensitive layer provided on the emulsion layer which is farthest from the support contains hydroquinone or derivatives thereof in an amount of 0.020 g/m$^2$ or less.

5. The silver halide color photographic material as in claim 1, wherein $R_1$ is a substituted or unsubstituted alkyl group, alkoxy group, aryl group, or aryloxy group;

Y is a halogen atom or a group splitting at a sulfur, oxygen, or nitrogen atom, and one of the $Z_a$—$Z_b$ bond and the $Z_b$—$Z_c$ is a double bond.

6. The silver halide color photographic material as in claim 1, wherein the magenta coupler is present in an amount of $1\times10^{-3}$ to 1 mol per mol of silver halide.

7. The silver halide color photographic material as in claim 2, wherein $X_1$, $X_2$, $X_3$, $R_2$ and $R_3$ are the same or different and are selected from among a halogen atom, a nitro group, a cyano group, a hydroxy group, a carboxyl group, a sulfo group, an amino group, an alkyl group, an aryl group, an alkoxy group, an aryloxy group, an alkylthio group, an arylthio group, an acyl group, a sulfonyl group, a carbamoyl group, a sulfamoyl group, an alkoxycarbonyl group, an alkoxysulfonyl, an amide group, a sulfonamide group, an ureido group, and a urethane group.

8. The silver halide color photographic material as in claim 2, wherein the molecular weight of said anti-color mixing agent is 500 or more.

9. The silver halide color photographic material as in claim 1, wherein the total coated amount of the anti-color mixing agent is 0.05 to 0.5 g/m$^2$.

10. The silver halide color photographic material as in claim 1, wherein the at least one high boiling organic solvent comprises an ester, an organic acid amide or ketone each having a dielectric constant of 6.0 or more.

11. The silver halide color photographic material as in claim 1, wherein the high boiling organic solvent has a boiling point of 140° C. or more.

12. The silver halide color photographic material as in claim 1, wherein the silver halide grains have an iodide content of 1 mol% or less.

13. The silver halide color photographic material as in claim 1, wherein the silver halide grains have a silver chloride content of 95 mol% or more.

14. The silver halide color photographic material as in claim 4, wherein the light-insensitive layer provided on the emulsion layer which is farthest from the support includes a UV absorbing agent.

15. The silver halide color photographic material as in claim 7, wherein $X_3$ is a hydroxy group or a sulfonamide group and $X_1$, $X_2$, $R_2$ and $R_3$ each is a hydrogen atom, a halogen atom, an alkyl group, an aryl group, an amide group, or a ureido group.

16. The silver halide color photographic material as in claim 15, wherein $X_3$ is a hydroxyl group and at least one of $X_1$, $X_2$, $R_2$ and $R_3$ is an alkyl group.

17. The silver halide color photographic material as in claim 1, wherein the ratio of the high boiling organic solvent to the anti-color mixing agent in the anti-color mixing layer is 0.3 to 20 by weight.

18. The silver halide color photographic material as in claim 2, wherein X3 is a hydroxyl group, both of $X_2$ and $R_2$ are an unsubstituted linear or branched alkyl group and both of $X_1$ and $R_3$ are a hydrogen atom.

* * * * *